US008484992B2

(12) United States Patent
Parsnick et al.

(10) Patent No.: US 8,484,992 B2
(45) Date of Patent: Jul. 16, 2013

(54) KRYPTON XENON RECOVERY FROM PIPELINE OXYGEN

(75) Inventors: David Ross Parsnick, Amherst, NY (US); Neil Mark Prosser, Lockport, NY (US); Ihuaku Ihejirika, Amherst, NY (US)

(73) Assignee: Praxair Technology, Inc., Danbury, CT (US)

( * ) Notice: Subject to any disclaimer, the term of this patent is extended or adjusted under 35 U.S.C. 154(b) by 895 days.

(21) Appl. No.: 12/629,408

(22) Filed: Dec. 2, 2009

(65) Prior Publication Data

US 2011/0126585 A1 Jun. 2, 2011

(51) Int. Cl.
*F25J 3/00* (2006.01)

(52) U.S. Cl.
USPC ..... 62/648; 62/643; 62/925

(58) Field of Classification Search
USPC ..... 62/640, 643, 648, 925
See application file for complete search history.

(56) References Cited

U.S. PATENT DOCUMENTS

| | | | | |
|---|---|---|---|---|
| 5,069,698 | A | 12/1991 | Cheung et al. | |
| 6,378,333 | B1 * | 4/2002 | Dray | 62/648 |
| 6,666,048 | B1 * | 12/2003 | Brugerolle et al. | 62/644 |
| 6,694,775 | B1 * | 2/2004 | Higginbotham et al. | 62/643 |
| 2003/0206849 | A1 * | 11/2003 | Griffiths et al. | 423/262 |
| 2006/0021380 | A1 | 2/2006 | Jaouani et al. | |

FOREIGN PATENT DOCUMENTS

DE 2605305 A1 8/1977

* cited by examiner

*Primary Examiner* — Frantz Jules
*Assistant Examiner* — Keith Raymond
(74) *Attorney, Agent, or Firm* — David M. Rosenblum

(57) ABSTRACT

A method and apparatus for producing a krypton-xenon-rich stream in which a pipeline oxygen stream is removed from an oxygen pipeline at ambient temperature and then distilled in a cryogenic rectification plant to produce the krypton-xenon-rich stream from a column bottoms of a distillation column. The plant can generate its own refrigeration by way of a heat pump loop incorporating an expander or, alternatively, refrigeration can be added by means of a liquid oxygen reflux stream introduced into the top of such distillation column.

4 Claims, 2 Drawing Sheets

KRYPTON XENON RECOVERY FROM PIPELINE OXYGEN

FIELD OF THE INVENTION

The present invention relates to a method and apparatus for producing a krypton-xenon-rich stream from oxygen flowing in an oxygen pipeline that can be further processed to produce krypton and xenon products. More particularly, the present invention relates to such a method in which an oxygen stream is removed from an oxygen pipeline and then introduced into a cryogenic rectification process that produces the krypton-xenon-rich stream from bottoms liquid within a distillation column.

BACKGROUND OF THE INVENTION

Krypton and xenon are rare gases that are used in a variety of industrial, commercial, and medical applications and are typically recovered from air. Air contains approximately 78.08 percent nitrogen, 20.95 percent oxygen and 0.93 percent argon, on a moisture-free basis. The remainder of the air contains carbon dioxide, heavier hydrocarbons and trace amounts of neon, helium, krypton, hydrogen and xenon. Typically, krypton is present in an amount of about 1.14 part per million by volume and xenon is present in an amount of about 0.087 parts per million by volume.

Krypton and xenon are recovered from the air by cryogenic distillation that involves the steps of compressing, cooling the air and then rectifying the air in distillation column having high and low pressure columns operatively associated with one another in a heat transfer relationship so that an oxygen-rich column bottoms collects in the low pressure column that is used to condense a nitrogen-rich vapor overhead produced in the higher pressure column. The resulting liquid nitrogen is used to reflux both the high and the low pressure column. The krypton and xenon will collect in the oxygen produced in the low pressure column due to the fact that both the krypton and xenon have a lower volatility than oxygen. Consequently, a liquid oxygen stream, removed from the low pressure column will initially be distilled in a distillation column to produce a krypton-xenon-rich stream that can be further processed through a series of distillation steps to produce krypton and xenon products. In such further processing, heavier hydrocarbons that will also collect in the oxygen are removed.

The distillation column used in connection with the initial concentrating of the krypton and xenon from the liquid oxygen stream is generally integrated into the air separation plant itself. An example of this is shown in U.S. Pat. No. 6,378,333 in which a liquid oxygen stream is removed from the low pressure column and then introduced into the top of a distillation column used to concentrate xenon in a bottoms liquid formed within such column. The distillation column is reboiled with nitrogen-rich vapor from the high pressure column that is in turn condensed to serve as reflux to the high pressure column. A portion of the bottoms liquid can be removed, sent to a trap to remove hydrocarbons and then reintroduced into the distillation column. In U.S. Pat. No. 6,694,775, a liquid oxygen stream is removed from the low pressure column and pumped to produce a pressurized liquid oxygen stream. Part of the pumped liquid oxygen stream is partially heated in a heat exchanger and vaporized. The resulting high pressure oxygen vapor is rectified in a distillation column that is refluxed with a remaining part of the pumped liquid oxygen stream. The heat exchanger is used to condense a compressed air stream that, after condensation, is fed into the double column unit. Part of the compressed air can be used to reboil the distillation column. In US Patent Appln. No. 2006/0021380 A1, unlike the other two patents, a stream of crude liquid oxygen derived from bottoms liquid produced in the high pressure column is further refined in an auxiliary distillation column that is reboiled by an argon condenser to condense argon for reflux purposes within an argon column. The residual liquid from the auxiliary distillation column is taken as the krypton-xenon-rich stream.

The need for krypton and xenon has increased over time due to increased demands for the use of such gas in lighting and laser applications. Xenon is also used as an anesthetic. Thus, there also exists the need to retrofit cryogenic air separation plants to recover the krypton and xenon for such applications. The difficulty with such a retrofit is that it is difficult to modify an existing plant with apparatus such as set forth above.

As will be discussed, the present invention solves this problem by providing a process for the production of a krypton-xenon-rich stream that can be effectuated in a free standing apparatus that utilizes oxygen flowing from the plant in an oxygen pipeline.

SUMMARY OF THE INVENTION

The present invention provides a method of producing a krypton-xenon-rich stream in which a pipeline oxygen stream, containing oxygen vapor, is removed from an oxygen pipeline at ambient temperature. The pipeline oxygen stream is introduced into a cryogenic rectification process to produce the krypton-xenon-rich stream. In the cryogenic rectification process, the pipeline oxygen stream is cooled to a temperature at or near a dew point temperature of the oxygen vapor contained in the pipeline oxygen stream. At least part of the pipeline oxygen stream, after having been cooled, is rectified in a distillation column to produce a krypton-xenon-rich liquid column bottoms. The krypton-xenon-rich stream is discharged from the distillation column and the krypton-xenon-rich stream composed of the krypton-xenon-rich liquid column bottoms. Refrigeration is imparted into the cryogenic rectification process.

The pipeline oxygen stream can be cooled in a main heat exchanger and the rectification of the pipeline oxygen stream produces an oxygen-rich vapor column overhead. An oxygen-rich vapor stream, composed of the oxygen-rich vapor column overhead, is removed from the distillation column and divided into a first oxygen-rich vapor stream and a second oxygen-rich vapor stream. The first oxygen-rich vapor stream is condensed in a condenser to produce a reflux stream and at least part of the reflux stream is introduced into the distillation column as reflux. The second oxygen-rich vapor stream is passed in indirect heat exchange with the pipeline oxygen stream from the oxygen pipeline in the main heat exchanger to assist in the cooling of the pipeline oxygen stream. The second oxygen-rich vapor stream is recycled back to the oxygen pipeline.

A heat exchange stream can be compressed and then cooled within the main heat exchanger. The heat exchange stream is condensed in a reboiler operatively associated with the distillation column to produce boil-up within the distillation column. The heat exchange stream, after having been condensed, is reduced in pressure and vaporized in the condenser in indirect heat exchange with the first oxygen-rich vapor stream, thereby to condense the first oxygen-rich vapor stream. The heat exchange stream, after having been vaporized, is partially warmed within the main heat exchanger and then expanded in a turboexpander to produce an exhaust stream and the turboexpander is coupled to a compressor used in compressing the heat exchange stream. The exhaust stream is fully warmed within the main heat exchanger to impart the refrigeration to the cryogenic rectification process and is recycled back to the compressor.

In another embodiment, a heat exchange stream can be cooled within the main heat exchanger and then, condensed in a reboiler located within the distillation column to produce boil-up within the distillation column. The heat exchange stream, after having been condensed, is vaporized in the condenser in indirect heat exchange with the first oxygen-rich vapor stream, thereby to condense the first oxygen-rich vapor stream and the heat exchange stream, after having been vaporized, is fully warmed within the main heat exchanger and then recycled back to the main heat exchanger. At least part of the reflux stream is introduced into the distillation column as part of the reflux thereof and an oxygen liquid stream is introduced into the distillation column to provide a further part of the reflux therefor and to impart the refrigeration into the cryogenic rectification process.

In another embodiment, the pipeline oxygen stream can be divided into a first oxygen vapor stream and a second oxygen vapor stream after having been cooled in the main heat exchanger. The first oxygen vapor stream can be expanded, introduced into the distillation column and rectified. The second oxygen vapor stream can be condensed in a reboiler operatively associated with the distillation column to produce boil-up for the distillation column and then expanded, after having been condensed and re-vaporized in the condenser in indirect heat exchange with the first oxygen-rich vapor stream. The second oxygen vapor stream, after having been re-vaporized, is fully warmed within the main heat exchanger, compressed and at least in part is recycled back into the oxygen pipeline. At least part of the reflux stream is passed into the distillation column as part of the reflux and an oxygen liquid stream is introduced into the distillation column as another part of the reflux and to introduce the refrigeration into the cryogenic rectification process. In yet another embodiment, the pipeline oxygen stream can be divided into a first oxygen vapor stream and a second oxygen vapor stream. The first oxygen vapor stream is fully cooled within the main heat exchanger, introduced into the distillation column and rectified. The second oxygen vapor stream is compressed and fully cooled within the main heat exchanger and then condensed in a reboiler operatively associated with the distillation column to produce boil-up for the distillation column. The second oxygen vapor stream is expanded after having been condensed and re-vaporized in the condenser in indirect heat exchange with the first oxygen-rich vapor stream. The second oxygen vapor stream, after having been re-vaporized, is fully warmed within the main heat exchanger, compressed and at least in part is recycled back into the oxygen pipeline. At least part of the reflux stream is passed into the distillation column as part of the reflux therefor and an oxygen liquid stream is passed into the column as another part of the reflux and to impart the refrigeration into the cryogenic rectification process.

In any embodiment of the present invention, the reflux stream can be passed in indirect heat exchange with the oxygen liquid stream within a subcooler, thereby to subcool the reflux stream. The oxygen liquid stream, after having passed through the subcooler, is expanded and introduced into the distillation column. A first part of the reflux stream after having been subcooled is passed into the distillation column as the part of the reflux therefore and a second part of the reflux stream, after having been subcooled, is discharged from the cryogenic rectification process.

The present invention also relates to an apparatus for producing a krypton-xenon-rich stream. In accordance with this aspect of the present invention, a cryogenic rectification plant is connected to an oxygen pipeline. The plant is configured to rectify a pipeline oxygen stream removed from an oxygen pipeline at ambient temperature and to produce the krypton-xenon-rich stream. The cryogenic rectification plant has a main heat exchanger connected to the oxygen pipeline so as to receive the pipeline oxygen stream and is configured to cool the pipeline oxygen stream to a temperature at or near a dew point temperature of oxygen vapor contained in the pipeline oxygen stream. A distillation column is connected to the main heat exchanger so as to receive at least part of the pipeline oxygen stream and is configured to rectify the at least part of the pipeline oxygen stream to produce a krypton-xenon-rich liquid column bottoms and an oxygen-rich vapor column overhead. The distillation column is provided with an outlet to discharge the krypton-xenon-rich stream from the distillation column such that the krypton-xenon-rich stream is composed of the krypton-xenon-rich liquid column bottoms. A condenser is connected to the distillation column so as to condense a first oxygen-rich vapor stream composed of the oxygen-rich vapor column overhead and thereby form a reflux stream and to return at least part of the reflux stream to the distillation column as reflux. The distillation column is also connected to the main heat exchanger so that a second oxygen-rich vapor stream, composed of the oxygen-rich vapor column overhead, is passed in indirect heat exchange with the pipeline oxygen stream from the oxygen pipeline to assist in the cooling of the pipeline oxygen stream. The main heat exchanger is also connected to the oxygen pipeline so that the second oxygen-rich vapor stream is recycled back to the oxygen pipeline. A means for imparting refrigeration to the cryogenic rectification plant is also provided.

In one embodiment, a compressor can be provided to compress a heat exchange stream and the main heat exchanger is connected to the compressor to receive the heat exchange stream, after having been compressed and then to cool the heat exchange stream. A reboiler is operatively associated with the distillation column to produce boil-up within the distillation column and is connected to the main heat exchanger so as to receive the heat exchange stream and to condense the heat exchange stream. The condenser is connected to the reboiler and is configured to vaporize the heat exchange stream, after having been condensed, through indirect heat exchange with the first oxygen-rich vapor stream, thereby to condense the first oxygen-rich vapor stream. The main heat exchanger is connected to the condenser and configured to receive the heat exchange stream after having been vaporized and to partially warm the heat exchange stream. An expansion valve is positioned between the condenser and the reboiler to expand the heat exchange stream after having been condensed and the refrigeration imparting means comprises a turboexpander connected to the main heat exchanger to receive the heat exchange stream after having been partially warmed and to expand the heat exchange stream, thereby to produce an exhaust stream. The turboexpander is coupled to the compressor used in compressing the heat exchange stream and the main heat exchanger is also connected to the turboexpander and is configured to fully warm the exhaust stream within the main heat exchanger to impart the refrigeration to the cryogenic rectification plant. A recycle compressor is positioned between the compressor and the heat exchanger to raise the pressure and recycle the heat exchange stream back to the compressor.

In another embodiment, the main heat exchanger can be configured to cool a heat exchange stream. A reboiler is operatively associated with the distillation column to produce boil-up within the distillation column and is connected to the main heat exchanger so as to receive the heat exchange stream and to condense the heat exchange stream. The condenser is connected to the reboiler and configured to vaporize the heat exchange stream, after having been condensed, through indirect heat exchange with the first oxygen-rich vapor stream, thereby to condense the first oxygen-rich vapor stream. An expansion valve is positioned between the condenser and the reboiler to expand the heat exchange stream after having been condensed and the main heat exchanger is connected to the condenser and is configured to receive the heat exchange stream after having been vaporized and to fully warm the heat exchange stream. A recycle compressor is connected to the main heat exchanger to receive the heat exchange stream after having been fully warmed such that the heat exchange stream is raised in pressure and recycled back into the main heat exchanger to fully cool the heat exchange stream. The refrigeration imparting means comprises the distillation column having an inlet positioned to receive an oxygen liquid stream as another part of the reflux.

In another embodiment, the distillation column can be connected to the main heat exchanger such that a first oxygen vapor stream composed of part of the pipeline oxygen stream is introduced into the distillation column and rectified. A reboiler is operatively associated with the distillation column to produce boil-up for the distillation column and is connected to the main heat exchanger so that a second oxygen vapor stream composed of another part of the pipeline oxygen stream is introduced into the reboiler and condensed. The reboiler is connected to the condenser so that the second oxygen vapor stream is introduced into the condenser and is re-vaporized through indirect heat exchange with the first oxygen-rich vapor stream, thereby to condense the first oxygen-rich vapor stream. Expansion valves are positioned between the main heat exchanger and the distillation column so that the first oxygen vapor stream is expanded prior to being introduced into the distillation column and between the reboiler and the condenser so that the second oxygen vapor stream after having been condensed is expanded. A compressor is connected between the main heat exchanger and the oxygen pipeline so that the second oxygen vapor stream after having been fully warmed is compressed back to pipeline pressure and at least in part is recycled back into the oxygen pipeline. The refrigeration imparting means comprises the distillation column having an inlet positioned to receive an oxygen liquid stream as another part of the reflux.

In yet another embodiment, the main heat exchanger and a compressor are connected to the oxygen pipeline so that a first oxygen vapor stream composed of part of the pipeline oxygen stream fully cools within the main heat exchanger and a second oxygen vapor stream composed of another part of the pipeline oxygen stream is compressed in the compressor and fully cools within the main heat exchanger. A reboiler is operatively associated with the distillation column to produce boil-up for the distillation column is connected to the main heat exchanger so that the second oxygen vapor stream is condensed in the reboiler. The condenser is connected to the reboiler so that the second oxygen vapor stream is re-vaporized after having been condensed through indirect heat exchange with the first oxygen-rich vapor stream. An expansion valve is positioned between the condenser and the reboiler to valve expand the second oxygen vapor stream after having been condensed in the reboiler. The main heat exchanger is connected to the condenser so that the second oxygen vapor stream is fully warmed within the main heat exchanger after having been re-vaporized. Another compressor is positioned between the main heat exchanger and the oxygen pipeline to compress the second oxygen vapor stream back to pipeline pressure and at least in part recycle the second oxygen vapor stream back into the oxygen pipeline. The refrigeration imparting means comprises the distillation column having an inlet positioned to receive an oxygen liquid stream as another part of the reflux. In such embodiment, the condenser can be connected to the distillation column so that a first part of the reflux stream is introduced into the distillation column as part of the reflux thereof.

In any embodiment of the present invention, a subcooler can be connected to the condenser. The subcooler is configured to receive the reflux stream and the oxygen liquid stream so that the reflux stream is subcooled within the subcooler. The subcooler is connected to the distillation column so that the oxygen liquid stream is introduced into the distillation column after having passed through the subcooler, a first part of the reflux stream is introduced into the distillation column and a second part of the reflux stream is discharged from the cryogenic rectification plant. A further expansion valve is positioned between the subcooler and the distillation column so that the oxygen liquid stream is valve expanded before introduction into the distillation column.

BRIEF DESCRIPTION OF THE DRAWINGS

While the specification concludes with claims distinctly pointing out the subject matter that Applicants regard as their invention, it is believed that the invention will be better understood when taken in connection with the accompanying drawings in which:

In order to avoid needless repetition in the explanation of the various Figures, the same reference numbers are used for elements thereof having the same description.

DETAILED DESCRIPTION

Figure 1:
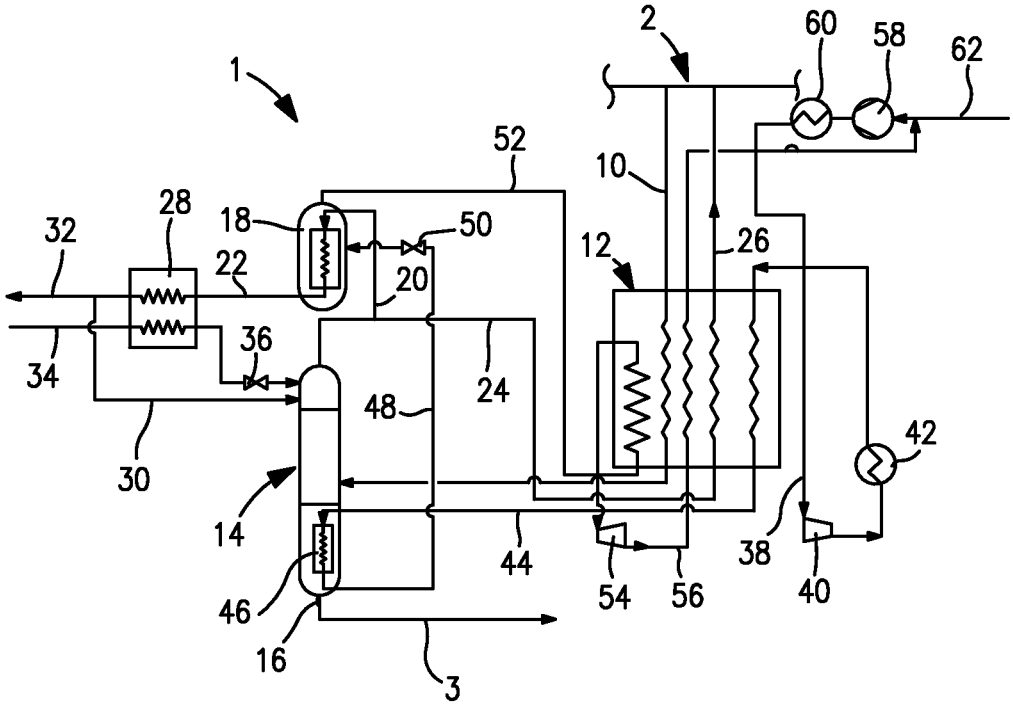
FIG. 1 is a schematic process flow diagram of an apparatus designed to carry out a method in accordance with the present invention.

With reference to FIG. 1, a cryogenic rectification plant 1 is illustrated that is designed to process oxygen vapor flowing through an oxygen pipeline 2 and thereby produce a krypton-xenon-rich stream 3 that can be further processed to produce krypton and xenon products. Typical compositions of the stream flowing through oxygen pipeline 2, on a percentile, volume basis are as follows: Oxygen: 0.9950-0.9995; Argon: 0.0050-0.0005; Nitrogen: 0.0; Krypton: 1.6-6.1 ppm; and Xenon: 0.12-0.46 ppm. Krypton-xenon-rich stream 3 will have the following composition: Oxygen: 0.9950-0.9995; Argon: 0.0050-0.0005; Nitrogen: 0.0; Krypton: 150-2600 ppm; and Xenon: 100-400 ppm. Cryogenic rectification plant 1 would be constructed as a retrofit to an existing air separation plant installation in which oxygen produced by such plant is being routed to an application utilizing such oxygen by means of an oxygen pipeline 2.

An oxygen pipeline stream 10 is removed from the oxygen pipeline 2 at ambient temperature and is composed of the oxygen vapor flowing through the oxygen pipeline 2. The oxygen pipeline stream 10 is introduced into a main heat exchanger 12 to cool the oxygen pipeline stream 10 to a temperature at or near its dewpoint. Main heat exchanger 12 can be of known braised aluminum plate-fin construction.

The resulting cooled oxygen pipeline stream 10 is then introduced into a distillation column 14 for rectification. Although not illustrated, distillation column 14 is provided with packing, either structured or random or a combination of the two type of packings or possibly sieve trays to contact an ascending vapor phase that becomes leaner in the krypton and xenon as it ascends and a descending liquid phase that become richer in the krypton and xenon as it descends such column. As a result, a krypton-xenon-rich column bottoms is produced at the bottom of distillation column 14 and an oxygen-rich vapor column overhead.

Distillation column 14 is provided with an outlet 16 to discharge the krypton-xenon-rich stream 3. A condenser 18 is connected to the top of distillation column 14 so as to condense a first oxygen-rich vapor stream 20 that is composed of the oxygen-rich vapor column overhead. The condensation produces a reflux stream 22 that as will be described is reintroduced, at least in part, into distillation column 14 as reflux. The distillation column 14 is also connected to the main heat exchanger 12 so that a second oxygen-rich vapor stream 24 passes in indirect heat exchange with the pipeline oxygen stream 10 to assist in the cooling of the pipeline oxygen stream 10. The second oxygen-rich vapor stream 24 is then recycled back to the oxygen pipeline 2 as a warm stream 26.

Although in cryogenic rectification plant 1, the reflux stream 22 in its entirety could be introduced into the top of distillation column 24, it can advantageously be subcooled in a subcooling unit 28. A first part 30 of the reflux stream 22 is introduced into the top of distillation column 14 as part of the reflux for such column. A second part 32 of the reflux stream 22 is discharged from the subcooling unit 14 as a subcooled, krypton and xenon depleted liquid oxygen stream. The heat exchange duty of the subcooling unit 28 is provided by a liquid oxygen stream 34 that after passing through the subcooling unit 28 is expanded to the pressure of distillation column 14 in an expansion valve 36 and then introduced as a remaining part of the reflux for distillation column 14.

Liquid oxygen stream 34 can be obtained from the same installation where oxygen vapor is produced to feed oxygen pipeline 2. In this regard, liquid oxygen stream 34 is derived from a pumped stream that is later vaporized and fed into the oxygen pipeline 2. As such, in the illustrated embodiments it is reduced in pressure to column pressure. However, if it were obtained at a lower pressure, expansion might not be necessary. The part 32 of the reflux stream 22 could be reintroduced into the air separation plant or possibly back to the oxygen pipeline 2. While optional in the cryogenic rectification plant 1, the use of the liquid oxygen stream 34 is advantageous in that it allows the krypton and xenon within such liquid oxygen to be recovered and further, such stream also provides some of the refrigeration load of the cryogenic rectification plant 1.

Cryogenic rectification plant 1 is designed to be a free standing plant and as such is also designed to produce its own refrigeration. This is done in a heat pump loop that uses nitrogen or suitable fluid as the heat exchange fluid. A heat exchange stream 38 is compressed by a compressor 40. After removal of the heat of compression by means of an aftercooler 42, the heat exchange stream is cooled in the main heat exchanger 12 to produce a cooled heat exchange stream 44. A reboiler 46 located in the bottom of the distillation column 14 is connected to the main heat exchanger 12 to receive the cooled heat exchange stream 44 and to produce boil up within the distillation column 14 and thereby initiate formation of the ascending vapor phase from vaporized krypton-xenon-rich liquid column bottoms. This condenses the cooled heat exchange stream 44 and thereby produces a condensed heat exchange stream 48. Condensed heat exchange stream 48 is then passed through an expansion valve 50 to cool such stream and thereby condense the first oxygen-rich vapor stream 20. This re-vaporizes the heat exchange stream to produce a re-vaporized heat exchange stream 52 that is partially warmed within main heat exchanger 12 and then introduced into a turboexpander 54 to produce an exhaust stream 56. As used herein and in the claims, the term "partially warmed" in such context means warmed to a temperature between the warm and cold end temperature of the main heat exchanger 12. The refrigeration is imparted by warming the exhaust stream 56 in the main heat exchanger 12. The exhaust stream is then introduced into a recycle compressor 58 and after cooling within an aftercooler 60 is recirculated back to the compressor 40 as the heat exchanger stream 38. A makeup for the heat exchange fluid can also be introduced as a makeup stream 62 to replace heat exchange fluid that is lost due to leakage. As can be appreciated, the compression of the heat exchange stream represents an energy outlay and cost. This energy cost can be reduced if part of the refrigeration requirement for the plant is provided by liquid oxygen stream 34.

Figure 2:
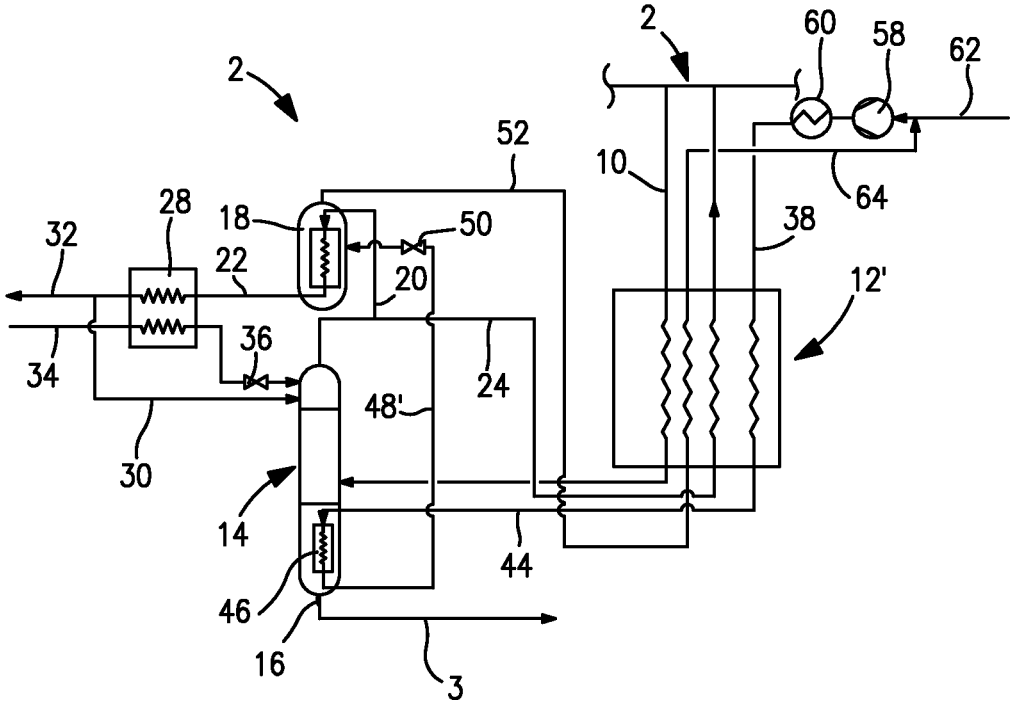
FIG. 2 is a schematic process flow diagram of an alternative embodiment of the apparatus illustrated in FIG. 1.

With reference to FIG. 2, a cryogenic rectification plant 2 is illustrated that is an alternative embodiment of the cryogenic rectification plant 1. Unlike cryogenic rectification plant 1, cryogenic rectification plant 2 is not designed to be free-standing and hence, is not provided with a means to self-generate refrigeration. It does, however, employ a heat exchange loop in which heat exchange stream is cooled in a main heat exchanger 12' that differs from main heat exchanger 12 in that it is not provided with passages to partially warm the re-vaporized heat exchange stream 52. The resulting cool heat exchanger stream 44 is again introduced into reboiler 46 and condensed to produce a condensed heat exchange stream 48' that, after passage through expansion valve 50, is re-vaporized to produce the re-vaporized heat exchange stream 52. The re-vaporized heat exchange stream 52 is warmed within the main heat exchanger 12' to produce a warm heat exchange stream 64 that is reintroduced into the compressor 58. The refrigeration is imparted into the cryogenic rectification plant solely by liquid oxygen stream 34. In this regard, liquid oxygen stream 34 could be introduced directly into distillation column 14 without subcooling the reflux stream 22 and the reflux stream could be introduced in its entirety into the distillation column 14.

Figure 3:
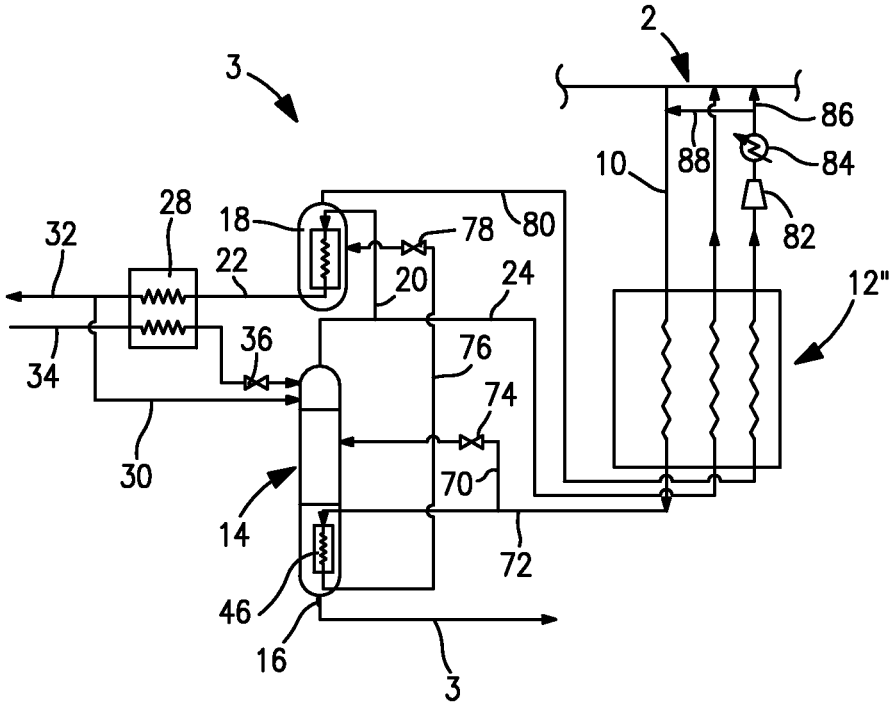
FIG. 3 is a schematic process flow diagram of a further alternative embodiment of an apparatus designed to carry out a method in accordance with the present invention.

With reference to FIG. 3, a yet further embodiment of the present invention is illustrated that incorporates a cryogenic rectification plant 3. Cryogenic rectification plant 3, as cryogenic rectification plant 2, is not designed to be self-standing and as such is refrigerated externally by liquid oxygen stream 34. The rectification is driven, however, not be a heat pump loop, but rather by the pipeline oxygen stream 10. In this regard, the oxygen produced in the air separation plant supplying oxygen pipeline 2 would be compressed or supplied at about 15 psi higher than the embodiments discussed above. Pipeline oxygen stream 10 is cooled in a main heat exchanger 12" that has fewer heat exchange passages than main heat exchangers 12 or 12' given that it does not include a recycled heat exchange stream. The cooled pipeline oxygen stream is divided into a first oxygen vapor stream 70 and a second oxygen vapor stream 72. First oxygen vapor stream 70 is valve expanded in an expansion valve 74, introduced into the distillation column 14 and rectified. The second oxygen vapor stream 72 is introduced into reboiler 46 and condensed. The resulting condensed oxygen vapor stream 76 is then reduced in pressure by an expansion valve 78 and introduced into condenser 18 where it is re-vaporized in the production of the reflux. The reduction in pressure, lowers the temperature of the condensed oxygen vapor stream 76 so that it can operate to condense reflux for the distillation column 14. In a like manner the reduction in pressure of the first oxygen vapor stream 70 lowers its temperature so that second oxygen vapor stream 72 can be condensed in reboiler 46.

The re-vaporized oxygen vapor stream 80 is warmed within main heat exchanger 12", compressed back to pipeline pressure in a compressor 82. After removal of the heat of compression in an aftercooler 84, a resulting first compressed oxygen vapor stream 86 is reintroduced into the oxygen pipeline 2. Optionally, a second compressed oxygen vapor stream 88 can be recycled back to the pipeline oxygen stream 10 given that such stream has a krypton and xenon content that can be recovered.

Figure 4:
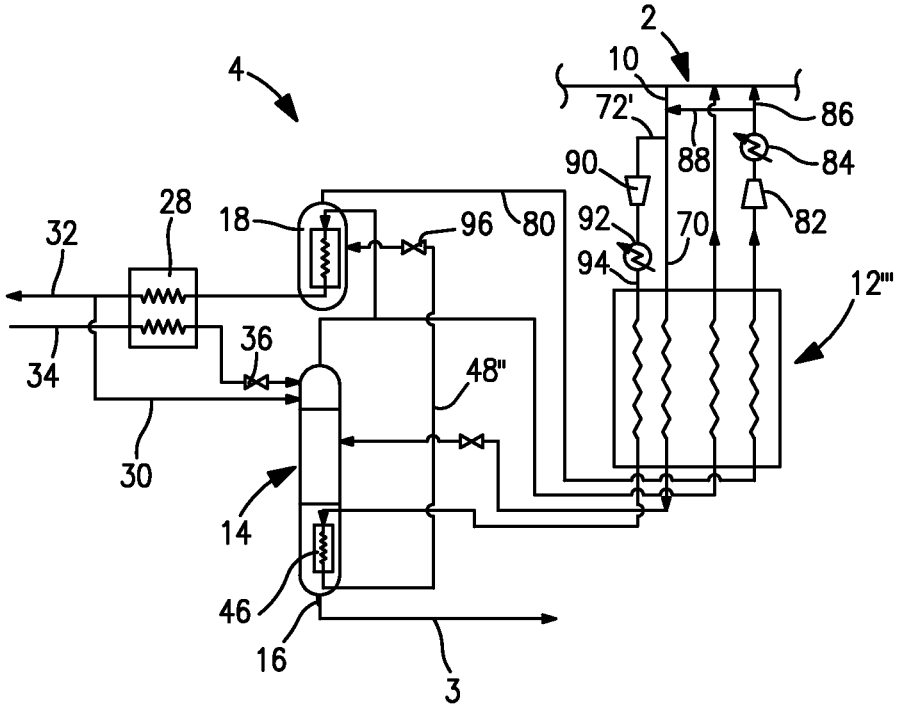
FIG. 4 is a schematic process flow diagram of an alternative embodiment of the apparatus illustrated in FIG. 3.

FIG. 4 illustrates a cryogenic rectification plant 4 that is an alternative embodiment of the cryogenic rectification plant 3. In cryogenic rectification plant 4, the pipeline oxygen stream 10 is divided into a first oxygen vapor stream 70' and a second oxygen vapor stream 72' prior to a main heat exchanger 12'''. First oxygen vapor stream 70' is cooled within main heat exchanger 12''' and then introduced into distillation column 14 for rectification. The second oxygen vapor stream 72' is compressed by a compressor 90 and after removal of the heat of compression in an aftercooler 92, is cooled, as a compressed oxygen vapor stream 94. As is apparent, in such embodiment not all of the oxygen need be compressed to a higher pressure in order to drive the distillation as is the case in cryogenic rectification plant 3.

Compressed oxygen vapor stream 94 is introduced into reboiler 46 after cooling in main heat exchanger 12''' to form a condensed oxygen vapor stream 48". The condensed oxygen vapor stream 48" is re-vaporized within condenser 18 while condensing the reflux to form the revaporized oxygen vapor stream 80. Cryogenic rectification plant 4 otherwise functions in the same manner as cryogenic rectification plant 3.

In any of the embodiments illustrated above, the krypton-xenon-rich stream 3 could be further processed on site and near any of the cryogenic rectification plants discussed above in order to lessen the amount of liquid that would be necessary to be transported for final processing to produce the krypton and xenon products. This would be done by vaporizing the krypton-xenon-rich stream and then subjecting such stream to catalytic oxidation followed by carbon dioxide and water vapor removal. The resulting dry stream would then be cooled and distilled in a distillation column equipped with enough stages to increase the concentration of krypton in the krypton-xenon-rich stream 3 from 340 ppm to 55 percent and that of xenon from 260 ppm to 43 percent with an oxygen impurity of 1 percent. The refrigeration requirement for such column could be provided by a portion of the condensed heat transfer fluid 48.

The following Table is a calculated example of the embodiment of the present invention illustrated in FIG. 1 illustrating a stream summary and heat and mass balance of the various streams flowing within cryogenic rectification plant 1.

TABLE

| Stream | 10[1] | 10[2] | 24 | 20 | 30 |
|---|---|---|---|---|---|
| Vapour Fraction | 1 | 1 | 1 | 1 | 0 |
| Temperature [K] | 310.0 | 122.0 | 120.9 | 120.9 | 104.8 |
| Pressure [psia] | 159.7 | 157.2 | 157.2 | 157.2 | 156.2 |
| Flow [moles/hr] | 1000 | 1000 | 999 | 51 | 7 |
| Enthalpy [Btu/mol] | 115.7 | −2417.7 | −2436.8 | −2436.8 | −5200.5 |
| Mole Frac (Nitrogen) | 0 | 0 | 0 | 0 | 0 |
| Mole Frac (Argon) | 0.00398 | 0.00398 | 0.00398 | 0.00398 | 0.00398 |
| Mole Frac (Oxygen) | 0.996 | 0.996 | 0.996 | 0.996 | 0.996 |
| Mole Frac (Krypton) | 5.59E−06 | 5.59E−06 | 5.11E−06 | 5.11E−06 | 5.11E−06 |
| Mole Frac (Xenon) | 4.26E−07 | 4.26E−07 | 5.39E−08 | 5.39E−08 | 5.39E−08 |

| Stream | 32 | 34 | 38 | 44 | 48 |
|---|---|---|---|---|---|
| Vapour Fraction | 0 | 0 | 1 | 1 | 0 |
| Temperature [K] | 104.8 | 93.7 | 310.0 | 124.0 | 122.4 |
| Pressure [psia] | 156.2 | 159.7 | 253.0 | 412.0 | 412.0 |
| Flow [moles/hr] | 44 | 44 | 96 | 96 | 96 |
| Enthalpy [Btu/mol] | −5200.5 | −5469.1 | 108.0 | −2796.1 | −3827.0 |
| Mole Frac (Nitrogen) | 0 | 0 | 1 | 1 | 1 |
| Mole Frac (Argon) | 0.00398 | 0.00398 | 0 | 0 | 0 |
| Mole Frac (Oxygen) | 0.996 | 0.996 | 0 | 0 | 0 |
| Mole Frac (Krypton) | 5.11E−06 | 5.59E−06 | 0 | 0 | 0 |
| Mole Frac (Xenon) | 5.39E−08 | 4.26E−07 | 0 | 0 | 0 |

| Stream | 52 | 52[3] | 56[4] | 56[5] | 3 |
|---|---|---|---|---|---|
| Vapour Fraction | 1 | 1 | 1 | 1 | 0 |
| Temperature [K] | 119.0 | 195.0 | 126.4 | 304.3 | 121.0 |
| Pressure [psia] | 299.50 | 296.5 | 50.0 | 46.0 | 158.0 |
| Flow [moles/hr] | 96 | 96 | 96 | 96 | 1.5 |
| Enthalpy [Btu/mol] | −2644.8 | −1407.0 | −2165.8 | 68.8 | −4811.3 |
| Mole Frac (Nitrogen) | 1 | 1 | 1 | 1 | 0 |
| Mole Frac (Argon) | 0 | 0 | 0 | 0 | 0.00193 |
| Mole Frac (Oxygen) | 0 | 0 | 0 | 0 | 0.9962 |
| Mole Frac (Krypton) | 0 | 0 | 0 | 0 | 3.42E−04 |
| Mole Frac (Xenon) | 0 | 0 | 0 | 0 | 2.65E−04 |

[1]Pipeline oxygen stream before main heat exchanger 12

[2]Pipeline oxygen stream after main heat exchanger 12

[3]Re-vaporized heat exchange stream 52 after partial warming within main heat exchanger 12

[4]Exhaust stream 56 prior to warming within main heat exchanger 12

[5]Exhaust stream 56 after warming within main heat exchanger 12

While the present invention has been discussed with reference to preferred embodiments, as would occur to those skilled in the art, numerous changes and omission could be made in such embodiments without departing from the spirit and scope of the present invention as set forth in the appended claims.

The invention claimed is:

1. A method of producing a krypton-xenon-rich stream comprising:

removing a pipeline oxygen stream, containing oxygen vapor, from an oxygen pipeline at ambient temperature; and introducing the pipeline oxygen stream into a cryogenic rectification process to produce the krypton-xenon-rich stream, said cryogenic rectification process comprising:

cooling the pipeline oxygen stream to a temperature at or near a dew point temperature of the oxygen vapor contained in the pipeline oxygen stream;

rectifying at least part of the pipeline oxygen stream, after having been cooled, in a distillation column to produce a krypton-xenon-rich liquid column bottoms;

discharging the krypton-xenon-rich stream from the distillation column, the krypton-xenon-rich stream composed of the krypton-xenon-rich liquid column bottoms;

imparting refrigeration into the cryogenic rectification process;

the pipeline oxygen stream is cooled in a main heat exchanger;

the rectification of the pipeline oxygen stream produces an oxygen-rich vapor column overhead;

an oxygen-rich vapor stream composed of the oxygen-rich vapor column overhead is removed from the distillation column and divided into a first oxygen-rich vapor stream and a second oxygen-rich vapor stream;

the first oxygen-rich vapor stream is condensed in a condenser to produce a reflux stream;

at least part of the reflux stream is introduced into the distillation column as reflux:

the second oxygen-rich vapor stream is passed in indirect heat exchange with the pipeline oxygen stream from the oxygen pipeline in the main heat exchanger to assist in the cooling of the pipeline oxygen stream; the second oxygen-rich vapor stream is recycled back to the oxygen pipeline;

a heat exchange stream is compressed and then cooled within the main heat exchanger;

the heat exchange stream is condensed in a reboiler operatively associated with the distillation column to produce boil-up within the distillation column;

the heat exchange stream, after having been condensed, is reduced in pressure and vaporized in the condenser in indirect heat exchange with the first oxygen-rich vapor stream, thereby to condense the first oxygen-rich vapor stream;

the heat exchange stream after having been vaporized is partially warmed within the main heat exchanger and then expanded in a turboexpander to produce an exhaust stream;

the turboexpander is coupled to a compressor used in compressing the heat exchange stream; and the exhaust stream is fully warmed within the main heat exchanger to impart the refrigeration to the cryogenic rectification process and is recycled back to the compressor.

2. The method of claim 1, wherein:

the reflux stream is subcooled within a subcooler through indirect heat exchange with an oxygen liquid stream;

a first part of the reflux stream, after having been subcooled, is introduced into the distillation column as part of the reflux thereof; and the oxygen liquid stream is valve expanded in an expansion valve and introduced into the distillation column as a further part of the reflux therefor.

3. An apparatus for producing a krypton-xenon-rich stream comprising:

a cryogenic rectification plant connected to an oxygen pipeline and configured to rectify a pipeline oxygen stream removed from an oxygen pipeline at ambient temperature and to produce the krypton-xenon-rich stream; said cryogenic rectification plant comprising:

a main heat exchanger connected to the oxygen pipeline so as to receive the pipeline oxygen stream, the main heat exchanger configured to cool the pipeline oxygen stream to a temperature at or near a dew point temperature of oxygen vapor contained in the pipeline oxygen stream;

a distillation column connected to the main heat exchanger so as to receive at least part of the pipeline oxygen stream, the distillation column configured to rectify the at least part of the pipeline oxygen stream to produce a krypton-xenon-rich liquid column bottoms and an oxygen-rich vapor column overhead and having an outlet to discharge the krypton-xenon-rich stream from the distillation column such that the krypton-xenon-rich stream is composed of the krypton-xenon-rich liquid column bottoms;

a condenser connected to the distillation column so as to condense a first oxygen-rich vapor stream composed of the oxygen-rich vapor column overhead and thereby form a reflux stream and to return at least part of the reflux stream to the distillation column as reflux;

the distillation column also connected to the main heat exchanger so that a second oxygen-rich vapor stream, composed of the oxygen-rich vapor column overhead, is passed in indirect heat exchange with the pipeline oxygen stream from the oxygen pipeline to assist in the cooling of the pipeline oxygen stream;

the main heat exchanger also connected to the oxygen pipeline so that the second oxygen-rich vapor stream is recycled back to the oxygen pipeline;

means for imparting refrigeration to the cryogenic rectification plant;

a compressor compresses a heat exchange stream;

the main heat exchanger is connected to the compressor to receive the heat exchange stream after having been compressed and then to cool the heat exchange stream;

a reboiler operatively associated with the distillation column to produce boil-up within the distillation column, the reboiler connected to the main heat exchanger so as to receive the heat exchange stream and to condense the heat exchange stream;

the condenser connected to the reboiler and configured to vaporize the heat exchange stream, after having been condensed through indirect heat exchange with the first oxygen-rich vapor stream, thereby to condense the first oxygen-rich vapor stream;

the main heat exchanger connected to the condenser and configured to receive the heat exchange stream after having been vaporized and to partially warm the heat exchange stream;

an expansion valve is positioned between the condenser and the reboiler to expand the heat exchange stream after having been condensed;

the refrigeration imparting means comprises a turboexpander connected to the main heat exchanger to receive the heat exchange stream after having been partially warmed and to expand the heat exchange stream, thereby to produce an exhaust stream, the turboexpander coupled to the compressor used in compressing the heat exchange stream and the main heat exchanger also connected to the turboexpander and configured to fully warm the exhaust stream within the main heat exchanger to impart the refrigeration to the cryogenic rectification plant; and a recycle compressor is positioned between the compressor and the heat exchanger to raise the pressure and recycle the heat exchange stream back to the compressor.

4. The apparatus of claim 3, wherein:

a subcooler is connected to a condenser and is configured to receive the reflux stream and an oxygen liquid stream so that the reflux stream is subcooled within the subcooler;

the subcooler is connected to the distillation column so that the oxygen liquid stream is introduced into the distillation column after having passed through the subcooler, a first part of the reflux stream is introduced into the distillation column and a second part of the reflux stream is discharged from the cryogenic rectification plant; and a further expansion valve is positioned between the subcooler and the distillation column so that the oxygen liquid stream is valve expanded before introduction into the distillation column.

* * * * *